US006415518B1

(12) United States Patent
Sims

(10) Patent No.: US 6,415,518 B1
(45) Date of Patent: Jul. 9, 2002

(54) APPARATUS FOR LAYING OUT A BUILDING FOUNDATION

(76) Inventor: Warren R. Sims, 11108 S. 84th Ave., 1A, Palos Hills, IL (US) 60465

( * ) Notice: Subject to any disclaimer, the term of this patent is extended or adjusted under 35 U.S.C. 154(b) by 49 days.

(21) Appl. No.: 09/685,678

(22) Filed: Oct. 10, 2000

Related U.S. Application Data

(60) Provisional application No. 60/231,137, filed on Sep. 8, 2000.

(51) Int. Cl.[7] ..... B43L 7/10; G01B 3/12

(52) U.S. Cl. ..... 33/286; 33/1 G; 33/1 LE; 33/405; 33/775

(58) Field of Search ..... 33/286, 1 G, 1 LE, 33/227, 228, 285, 404, 405, 413, 772, 773, 775, DIG. 21

(56) References Cited

U.S. PATENT DOCUMENTS 1,401,200 A * 12/1921 Stevens ..... 33/1 LE
2,665,482 A * 1/1954 Rupp ..... 33/1 LE
2,685,739 A * 8/1954 Cole ..... 33/1 LE
3,061,931 A * 11/1962 Smith ..... 33/1 LE
4,703,563 A * 11/1987 Hoshino et al. ..... 33/227
5,894,675 A * 4/1999 Cericola ..... 33/286

* cited by examiner

*Primary Examiner*—Christopher W. Fulton
(74) *Attorney, Agent, or Firm*—Marshall, Gerstein, & Borun.

(57) ABSTRACT

An apparatus for laying out a building foundation is provided. The apparatus according to the present invention includes a first member for engaging a wire and a second member mounted to the first member and movable between a range of positions. The second member further includes a laser. A protractor is disposed between the first and second members for measuring the position of the second member in relation to the first member. The apparatus further includes a measuring device that is disposed adjacent to the first member for measuring a distance the apparatus travels along the wire.

14 Claims, 3 Drawing Sheets

APPARATUS FOR LAYING OUT A BUILDING FOUNDATION

CROSS-REFERENCE TO RELATED APPLICATIONS

Applicant claims benefit of the prior filed provisional patent application Ser. No. 60/231,137 filed Sep. 8, 2000.

TECHNICAL FIELD

The present invention relates generally to construction devices, and more specifically, to an apparatus for laying out a building foundation.

BACKGROUND OF THE ART

It is well known in the art to use lasers for construction measurement and alignment operations. Specifically, laser beam generators have been used as leveling devices by providing a reference line for a variety of construction related tasks that include, for example, surveying and pipe laying. Essentially, the leveled beam is deflected to a desired location, thereby allowing the marking of a construction line or the installation of a specific part, for example, to be accurately achieved. For example, a laser has been used to project a line on a large pipe which is in alignment with other measuring tools, such as an alignment guide pin, then the projected line is manually chalked on the pipe by a technician and the pipe is cut in any conventional manner.

Laser beams have also been used as a reference line for tunneling, irrigation work, alignment of railroad tracks and other applications, such as vehicle body manufacturing. In this regard, great benefit has been achieved by incorporating the use of laser beam references into such construction operations, especially those which require a high degree of accuracy. For example, leveling devices formerly used in surveying involved the use of imprecise surveying instruments and a great deal of human effort and time in order to properly position the device, mark a construction line or area, and/or install a part.

Although laser beam generators have been used in various building construction applications (as the foregoing explains), they have not been used in laying out a building foundation. Rather, technicians and construction workers manually lay out a building foundation, using conventional, often crude measuring tools and markers for indicating such layout. As a result, laying out an accurate building foundation and using such conventional measuring devices and methodologies involves a great deal of time and effort, for such devices are highly inaccurate. Moreover, in light of such time necessary to properly lay out such a building foundation accurately, the cost involved in such work is high and the process is not very efficient.

SUMMARY OF THE INVENTION

The present invention is directed to an apparatus for laying out a building foundation.

More particularly, and in accordance with one aspect of the present invention, an apparatus for horizontally laying out a building foundation comprises a first member for engaging a wire and a second member, pivotably mounted to the first member and movable between a range of positions. The second member further includes a laser generator. A protractor is disposed between the first member and the second member for measuring a position of the second member in relation to the first member. A measuring device is disposed adjacent to the first member for measuring a distance the apparatus travels along the wire.

More particularly, the first member may include a level. In addition, the first member may be rectangular in shape and include at least one wire guide. The wire guide may be made of steel.

In addition, the second member may be rectangular in shape and, further, may be made of aluminum.

The apparatus may further include at least one spacer disposed between the first member and the second member. The measuring device may comprise a wheel distance counter for measuring the linear distance the apparatus travels along the wire.

In accordance with another aspect of the present invention, an apparatus for horizontally laying out a building foundation comprises an elongated support having at least one wire guide for engaging a layout wire arranged at a building site. The apparatus further includes a laser level that is pivotably mounted to the support and movable within a range of positions. The laser level includes a laser generator. A protractor is disposed between the elongated support and the laser level for measuring a position of the laser level in relation to the support. A distance counter is disposed adjacent to the support for measuring the linear distance the apparatus travels along the layout wire.

DESCRIPTION OF THE PREFERRED EMBODIMENTS

Figure 1:
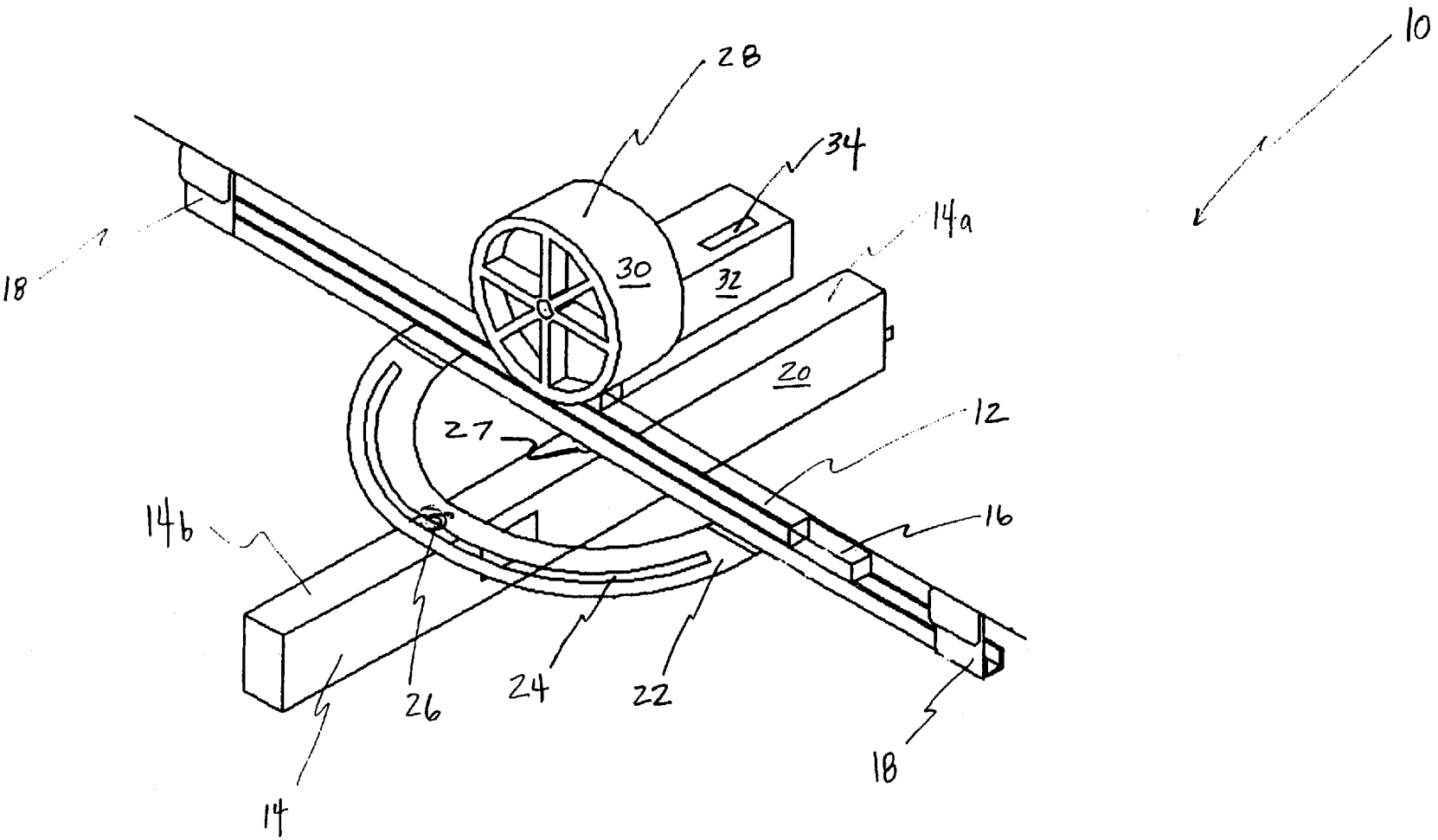
FIG. 1 is a perspective view of an apparatus for laying out a building foundation according to the present invention.
Figures 2, 3:
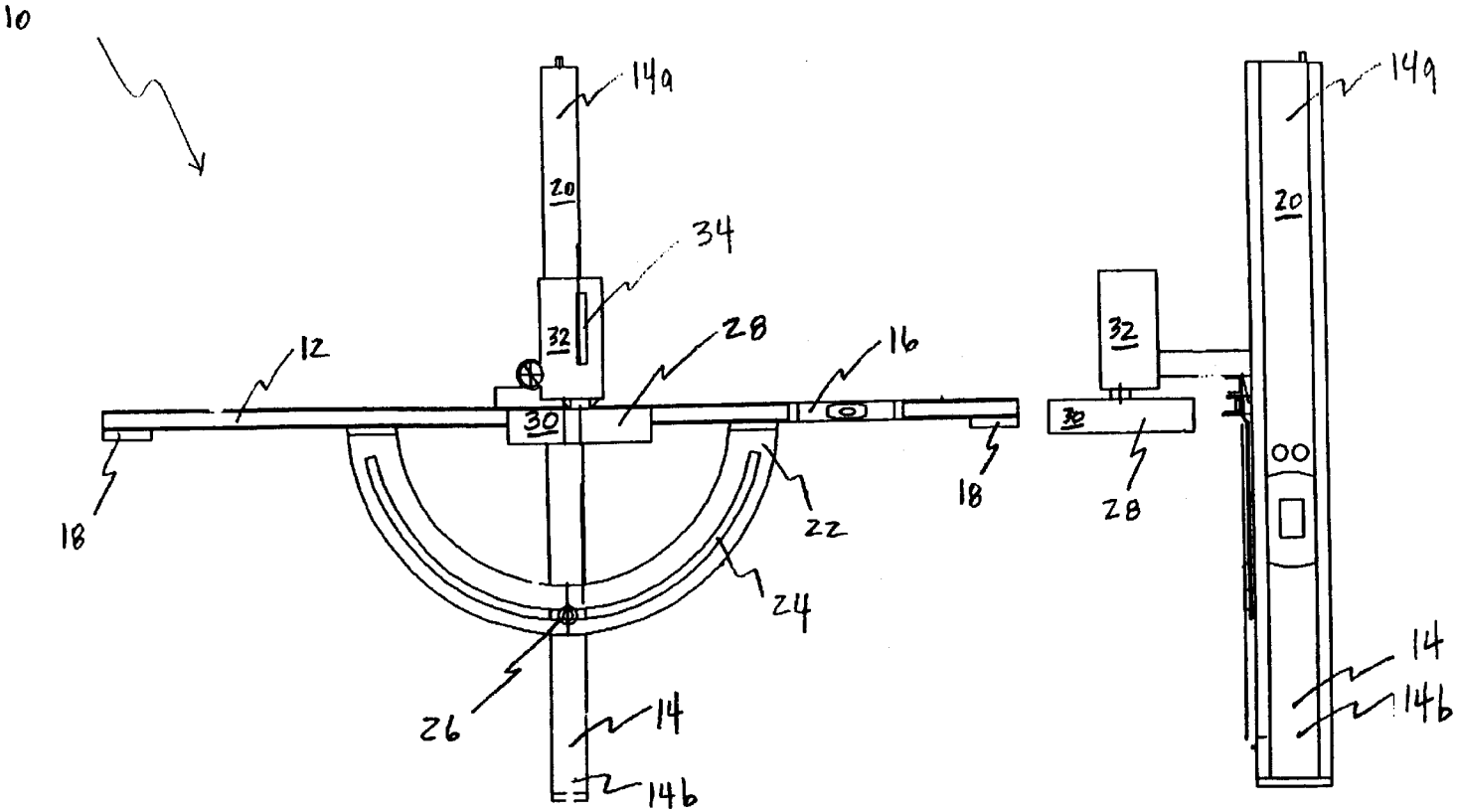
FIG. 2 is a top elevational view of the apparatus for laying out a building foundation.
FIG. 3 is a side elevational view of the apparatus for laying out a building foundation.

Referring now to FIGS. 1–3, an apparatus 10 for horizontally laying out a building foundation 10 is shown. The apparatus 10 includes a first member 12 and a second member 14. The second member 14 is pivotably mounted to the first member 12 at approximately the center of the second member 14 via an engaging means, such as a pivoting hinge or other similar fastener. The pivoting hinge or other similar fastener thereby allows the second member 14 to be moved between a range of positions relative to the first member 12.

The first member 12 includes a level 16 for aligning the apparatus 10 with a horizontal building site on which a building foundation is to be laid out. At least one wire guide 18, and preferably two wire guides 18 (as shown in FIG. 1), are disposed on opposite ends of the first member 12. The wire guides 18 engage a wire that is used in laying out the building foundation, as is more fully described hereinafter. The wire guides 18 may be made of a variety of materials, such as steel and the like.

The first member 12 may be an elongated, rectangularly shaped member or support. In addition, the first member 12 may be made of a variety of materials, such as aluminum and the like.

The second member 14 includes a laser beam generator 20 that is used for marking a desired building foundation layout, as is more fully explained hereinafter. The second member 14 further includes a first end 14*a* and a second end 14*b*. The second end 14*b* may be manually gripped and moved by an operator of the apparatus for purposes of moving the first end 14*a* of the second member 14, and ultimately projecting the laser beam to a desired location, as is more fully described hereinafter. The second member 14 is typically rectangular in shape, as is shown in FIGS. 1–3. In addition, the second member 14 may be made of a variety of metals, such as aluminum and the like.

A protractor 22, or other similar measuring device, is disposed between the first and second members 12 and 14 of the apparatus 10. The protractor 22 includes a slit 24 for engaging a knob-like portion 26 of the second member 14 of the apparatus 10. The slit 24 spans the circumference of the protractor 22, thereby allowing the second member 14 to be moved about a range of positions (along the circumference of the protractor 22) in relation to the first member 12, all of which may be accurately measured by the protractor 22. Essentially, the presence of the protractor 22 allows the second member 14 to be accurately moved to a desired position relative to the generator 20 from the laser beam first member 12, ultimately allowing a laser beam to be accurately projected to a desired location corresponding to the building layout foundation, as is more fully described hereinafter.

Like the protractor 22, a spacer 27 may be disposed between the first and second members 12 and 14 of the apparatus 10. The spacer 27 essentially provides an increased area between the first and second members 12 and 14 of the apparatus 10, thereby allowing the second member 14 to be more easily moved in relation to the first member 12, and ultimately allowing the laser beam to be projected more easily to a variety of locations.

The apparatus for laying out a building foundation 10 further includes a second measuring device or counter 28, that may be one of a variety of measuring devices, such as a wheel distance counter and the like. The counter 28 is disposed adjacent to the first member 12 of the apparatus 10 and is for measuring a distance the apparatus 10 travels along the layout wire, as is also more fully described hereinafter.

The counter 28 may include a first portion 30 that is circular in shape and contacts the first member 12 of the apparatus 10, thereby allowing the distance the apparatus 10 travels along a layout wire to be measured. The counter 28 may also include a second portion 32 that is rectangular is shape and may include electronic circuitry (not shown) disposed therein which automatically calculates the distance the apparatus 10 travels along the layout wire, as well as a small LCD screen 34 which then automatically displays the calculated distance the apparatus 10 travels along the layout wire.

Figure 4:
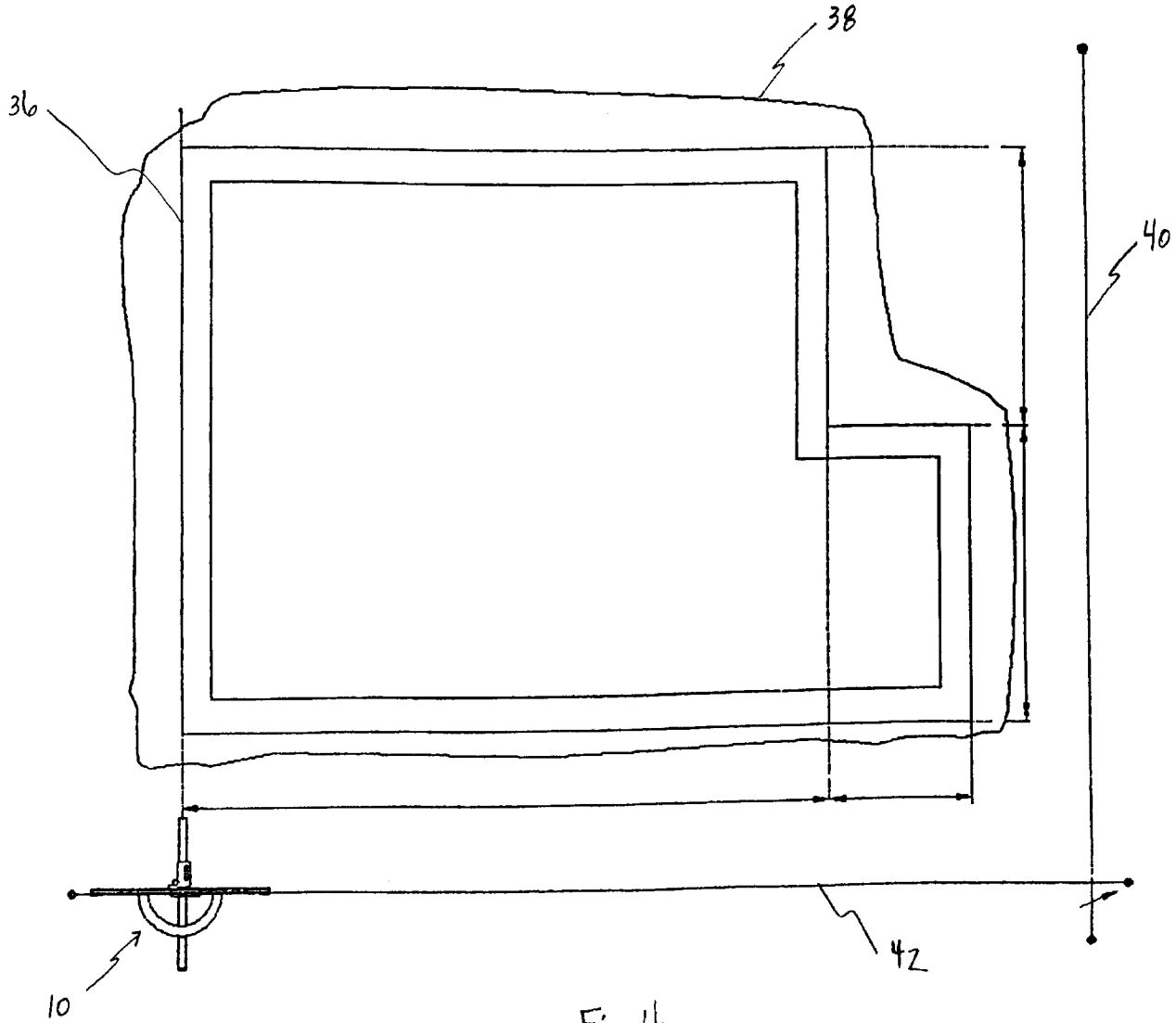
FIG. 4 is a diagram illustrating a layout of a building foundation at a building site.

Referring now to FIG. 4, a completed building layout 36 for a building foundation is shown. Essentially, the building layout 36 is arranged at an excavation area 38 or building site by setting a first layout wire 40 at the building site. A second layout wire 42 is then placed perpendicular to the first layout wire 40, thereby partially defining an area larger than the building layout 36.

After the first and second layout wires 40, 42 have been arranged, the apparatus 10 for laying out the building foundation is positioned to engage the first layout wire 40. The laser generator 20 of the second member 14 of the apparatus 10 is then activated to generate and project a laser beam perpendicular to the first layout wire 40. The apparatus 10 is then traversed along the first layout wire 40 to desired locations corresponding to the predetermined dimensions of the building foundation. More specifically, when the counter 28 of the apparatus 10 indicates a particular value that corresponds to a desired dimension of the building layout, the laser beam of the second member 14 is projected to that position or location. If necessary, the operator may manually move the second member 14 of the apparatus 10 in relation to the support or first member 12 to adequately project the laser to such a desired location.

After the laser beam has been accurately projected, the operator of the apparatus 10 manually marks such a location. The apparatus 10 then continues to be traversed along the first wire 40, and the process of measuring and marking such desired locations corresponding to the building foundation is repeated along the second layout wire 42 to complete the layout of the building foundation.

The apparatus 10 for laying out a building foundation has several advantages. For example, by having a laser beam projected to locations corresponding to a desired building foundation, the dimensions of the building foundation are more accurately measured and marked and the overall construction of the building is more accurate. In addition, operation of the apparatus 10 of the present invention, and ultimately, laying out a building foundation, does not require the large amount of time and effort necessary in operating the conventional measuring devices and methodologies used in laying out a building foundation. More specifically, because of the accuracy of the laser beam and the measuring device or counter 28 of the apparatus 10, an operator of the apparatus does not need to spend as much time actually measuring desired dimensions of such a building foundation layout and checking the accuracy of such measurements and calculations. Thus, the apparatus 10 of the present invention is more efficient than the conventional tools and measuring devices used in laying out a building foundation, which in turn results in a more cost efficient method of laying out a building foundation layout as well.

While the present invention has been described with reference to specific examples, which are intended to be illustrative only, and not to be limiting of the invention, it will be apparent to those of ordinary skill in the art that changes, additions and/or deletions may be made to the disclosed embodiments without departing from the spirit and scope of the invention. For example, the apparatus 10 may be used for virtually any horizontal layout, such as parking lot and roadway markings and playing field indicia and the like.

What is claimed is:

1. An apparatus for horizontally laying out a building foundation, comprising:

a first member for engaging a wire;

a second member, pivotably mounted to the first member and movable between a range of positions, including a laser generator;

a protractor disposed between the first member and the second member for measuring a position of the second member in relation to the first member; and a measuring device disposed adjacent to the first member for measuring a distance the apparatus travels along the wire.

2. The apparatus of claim 1, wherein the first member includes a level.

3. The apparatus of claim 1, wherein the first member is rectangular in shape.

4. The apparatus of claim 1, wherein the first member includes at least one wire guide.

5. The apparatus of claim 4, wherein the wire guide is made of steel.

6. The apparatus of claim 1, wherein the second member is made of aluminum.

7. The apparatus of claim 1, wherein the second member is rectangular in shape.

8. The apparatus of claim 1, wherein the apparatus further includes at least one spacer disposed between the first member and the second member.

9. The apparatus of claim 1, wherein the measuring device is a wheel distance counter for measuring the linear distance the apparatus travels along the wire.

10. An apparatus for horizontally laying out a building foundation, comprising:

an elongated support having at least one wire guide for engaging a layout wire arranged at a building site;

a laser level pivotably mounted to the support and movable within a range of positions including a laser generator;

a protractor disposed between the elongated support and the laser level for measuring a position of the laser level in relation to the support; and a distance counter disposed adjacent to the support for measuring the linear distance the apparatus travels along the layout wire.

11. The apparatus of claim 10, wherein the wire guide is made of steel.

12. The apparatus of claim 10, wherein the apparatus further includes at least one spacer disposed between the support and the laser level.

13. The apparatus of claim 10, wherein the elongated support includes a level.

14. The apparatus of claim 10, wherein the laser level includes a housing made of aluminum.

* * * * *